US009180326B2

(12) United States Patent
Van Schoor et al.

(10) Patent No.: US 9,180,326 B2
(45) Date of Patent: Nov. 10, 2015

(54) METHOD AND APPARATUS FOR THERMALLY ACTIVATED SPRINKLERS

(75) Inventors: Marthinus Cornelius Van Schoor, Medford, MA (US); Attila Jozsef Lengyel, Somerville, MA (US); Matthew Pike, Medford, MA (US)

(73) Assignee: Mide Technology Corporation, Medford, MA (US)

( * ) Notice: Subject to any disclaimer, the term of this patent is extended or adjusted under 35 U.S.C. 154(b) by 960 days.

(21) Appl. No.: 12/381,485

(22) Filed: Mar. 12, 2009

(65) Prior Publication Data

US 2009/0242218 A1 Oct. 1, 2009

Related U.S. Application Data

(60) Provisional application No. 61/069,291, filed on Mar. 13, 2008, provisional application No. 61/070,094, filed on Mar. 20, 2008.

(51) Int. Cl.
*A62C 37/11* (2006.01)
*A62C 37/08* (2006.01)

(52) U.S. Cl.
CPC ..... *A62C 37/11* (2013.01); *A62C 37/08* (2013.01)

(58) Field of Classification Search
CPC ..... A62C 37/11; A62C 37/14; A62C 37/08; A62C 37/12
USPC ..... 169/19, 26, 37–39, 57, 58, DIG. 3
See application file for complete search history.

(56) References Cited

U.S. PATENT DOCUMENTS

| | | | | |
|---|---|---|---|---|
| 4,109,727 | A * | 8/1978 | Job | 169/41 |
| 4,796,710 | A | 1/1989 | Job | |
| 4,881,915 | A | 11/1989 | Llaw | |
| 4,896,728 | A * | 1/1990 | Wolff et al. | 169/37 |
| 4,981,179 | A * | 1/1991 | Klein | 169/38 |
| 5,494,113 | A | 2/1996 | Polan | |
| 6,073,700 | A | 6/2000 | Tsuji et al. | |
| 6,491,110 | B2 | 12/2002 | Gil | |
| 6,554,077 | B2 | 4/2003 | Polan | |
| 7,096,964 | B2 * | 8/2006 | Dushkin et al. | 169/37 |

FOREIGN PATENT DOCUMENTS

GB 2120934 A 12/1983

OTHER PUBLICATIONS

International Searching Authority, International Search Report and Written Opinion of the International Searching Authority, for International Application No. PCT/US09/01615, mailed May 12, 2009, 9 pages (unnumbered).

* cited by examiner

*Primary Examiner* — Jason Boeckmann
(74) *Attorney, Agent, or Firm* — Iandiorio Teska & Coleman, LLP

(57) ABSTRACT

A sprinkler head including a sprinkler body with a passage for fluid and a seal mechanism sealing the passage, and a cage member. A frangible bulb extends between the cage member and the seal. A shape memory alloy element is associated with the frangible bulb and has a first configuration that fits within, about, or abutting the bulb and a second configuration at a predetermined temperature which breaks the frangible bulb releasing the fluid through the passage.

10 Claims, 13 Drawing Sheets

METHOD AND APPARATUS FOR THERMALLY ACTIVATED SPRINKLERS

RELATED APPLICATIONS

This application hereby claims the benefit of and priority to U.S. Provisional Application Ser. Nos. 61/069,291 filed on Mar. 13, 2008 and 61/070,094, filed on Mar. 20, 2008 under 35 U.S.C. §§119, 120, 363, 365, and 37 C.F.R. §1.55 and §1.78.

FIELD OF THE INVENTION

The subject invention relates to the field of sprinkler systems. In particular, the invention relates to method and apparatus for activating a water sprinkler system when the environmental temperature exceeds a predefined temperature.

BACKGROUND OF THE INVENTION

Fire sprinklers can be automatic or open orifice. Automatic fire sprinklers operate at a predetermined temperature, utilizing a fusible link, a portion of which melts, or a frangible glass bulb containing liquid which breaks the bulb at high temperatures. The water stream impacts a deflector, which produces a specific spray pattern, designed in support of the goals of the sprinkler type (i.e., control or suppression). Modern sprinkler heads are designed to direct spray downwards. Spray nozzles are available to provide spray in various directions and patterns. The majority of automatic fire sprinklers operate individually in a fire. Contrary to what is often shown in movies, the entire sprinkler system does not activate, unless the system is a special deluge type.

Open orifice sprinklers are only used in water spray systems or deluge sprinklers systems. They are identical to the automatic sprinkler on which they are based, with the heat sensitive operating element removed.

Automatic fire sprinklers utilizing frangible bulbs follow a standardized color-coding convention indicating their operating temperature. Activation temperatures correspond to the type of hazard against which the sprinkler system protects. Residential occupancies are provided with a special type of fast response sprinkler with the unique goal of life safety.

per square foot of floor area should be applied to the design area. For example, in an office building classified as light hazard, a typical design area would be 1500 square feet and the design density would be 0.1 gallons per minute per square foot or a minimum of 150 gallons per minute applied over the 1500 square foot design area. Another example would be a manufacturing facility classified as ordinary hazard group 2 where a typical design area would be 1500 square feet and the design density would be 0.2 gallons per minute per square foot or a minimum of 300 gallons per minute applied over the 1500 square foot design area.

After the design area and density have been determined, calculations are performed to prove that the system can deliver the required amount of water over the required design area. These calculations account for all of the pressure that is lost or gained between the water supply source and the sprinklers that would operate in the design area. This includes pressure losses due to friction inside the piping and losses or gains due to differences in elevation between the source and the discharging sprinklers. Sometimes momentum pressure from water velocity inside the piping is also calculated. Typically these calculations are performed using computer software but before the advent of computer systems these sometimes complicated calculations were performed by hand. This skill of calculating sprinkler systems by hand is still required training for a sprinkler system design Technologist who seeks senior level certification from engineering certification organizations such as the National Institute for Certification in Engineering Technologies (NICET).

Sprinkler systems in residential structures are becoming more common as the cost of such systems becomes more practical and the benefits become more obvious. Residential sprinkler systems usually fall under a residential classification separate from the commercial classifications mentioned above. A commercial sprinkler system is designed to protect the structure and the occupants from a fire. Most residential sprinkler systems are primarily designed to suppress a fire in such a way to allow for the safe escape of the building occupants. While these systems will often also protect the structure from major fire damage, this is a secondary consideration. In residential structures sprinklers are often omitted

| Maximum Ceiling Temperature | Temperature Rating | Temperature Classification | Color Code (with Fusible Link) | Glass Bulb Color |
|---|---|---|---|---|
| 100° F./38° C. | 135-170° F./57-77° C. | Ordinary | Uncolored or Black | Orange (135°) or Red (155°) |
| 150° F./66° C. | 175-225° F./79-107° C. | Intermediate | White | Yellow (175°) or Green (200°) |
| 225° F./107° C. | 250-300° F./121-149° C. | High | Blue | Blue |
| 300° F./149° C. | 325-375° F./163-191° C. | Extra High | Red | Purple |
| 375° F./191° C. | 400-475° F./204-246° C. | Very Extra High | Green | Black |
| 475° F./246° C. | 500-575° F./260-302° C. | Ultra High | Orange | Black |
| 625° F./329° C. | 650° F./343° C. | Ultra High | Orange | Black |

Most sprinkler systems installed today are designed using an area and density approach. First the building use and building contents are analyzed to determine the level of fire hazard. Usually buildings are classified as light hazard, ordinary hazard group 1, ordinary hazard group 2, extra hazard group 1, or extra hazard group 2. After determining the hazard classification, a design area and density can be determined by referencing tables in the National Fire Protection Association (NFPA) standards. The design area is a theoretical area of the building representing the worst-case area where a fire could burn. The design density is a measurement of how much water from closets, bathrooms, balconies, garages and attics because a fire in these areas would not usually impact the occupant's escape route.

If water damage or water volume is of particular concern, a technique called Water Mist Fire Suppression may be an alternative. This technology has been under development for over 50 years. It hasn't entered general use, but is gaining some acceptance on ships and in a few residential applications. Mist suppression systems work by lowering the temperature of a burning area through evaporation rather than "soaking". As such, they may be designed to only slow the spread of a fire and not extinguish it. Some tests that may or may not be biased, showed the cost of resulting fire and water damage with such a system installed to be dramatically less than conventional sprinkler systems.

The commercial market demands regarding glass bulbs for sprinklers for automatic fire extinguisher systems and also for other thermal release means, are for much shorter release times, which may be up to almost ten times shorter. Such shorter release times must be achieved without sacrificing durability of the glass drum or the axial loading in the sprinkler.

One prior proposal to meet these requirements consisted of reducing the volume of breaking liquid in the glass bulb by placing a solid displacement member in the bulb without modifying the dimensions of the glass body, and therefore without modifying the strength characteristics. See U.K. Patent No. 2,120,934, published Dec. 14, 1983. Attempts have also been made to reduce the release times by reducing the overall diameter of glass drum so as to bring about a more favorable ratio of the surface area to the volume of the bulb, and consequently of the volume of the breaking liquid in the bulb. However, these attempts have lead to an unacceptable reduction in strength.

In sprinklers, which constitute the main field of use for glass thermo bulbs, such bulbs act as a thermally active release member to keep a valve closed. The elongate bulb is generally secured at its ends between two ends of the sprinkler and the ends apply an axial force on the ends of bulb. In the case of a fire, the glass bulb shatters and allows the valve to open and to release the fire extinguishing medium, which is usually water.

Such a glass bulb typically comprises a hollow and generally cylindrical or barrel shaped enclose or shaft, the length of which may vary widely. The bulb is often provided with an annular offset or shoulder in the wall at one end of the shaft so as to form the thermally active part together with the expansible breaking fluid or liquid confined within the glass enclosure. At the ends, which engage sprinkler abutments, flat, conical or curved, and substantially thermally inactive ends bound the shaft. One of the ends is normally referred to as the tip end, which is thin and tapered to a rounded point. The expansible breaking fluid is introduced into the bulb through the tip end during manufacturing, and thereafter the tip end is closed.

The glass bulb must be able to take a specific permanent load which is dependent upon the nature of the valve construction or release mechanism in the sprinkler as to insure that the sprinkler remains closed over several decades and is always kept in a state of readiness.

The Response Time Index is a calculated value taking into account the actual activating time of a glass bulb mounted in a sprinkler or other devices in given standard conditions. Fast response times are associated with lower RTI values.

$$RTI = \frac{\left(-t_r\sqrt{u}\right)\left(1+\frac{C}{\sqrt{u}}\right)}{\ln\left[1-\left[\frac{(T_{ea}-T_u)\left(1+\frac{C}{\sqrt{u}}\right)}{T_g-T_u}\right]\right]} \quad (1)$$

RTI=Response Time Index $[(ms)^{1/2}]$ $t_r$=actual response time of thermal release element (s)

u=actual gas velocity in the test section of the wind tunnel (m/s)

$T_{ea}$=mean liquid bath operating temperature of sensitive detector element (° C.)

$T_g$=actual gas temperature in test section (° C.)

$T_u$=ambient air temperature during testing (° C.)

C=Conductivity Factor $[(m/s)^{1/2}]$

UL Conditions: 135° C. at 2.54 m/s

Thermo bulbs with response times slower than an RTI value of 80 is used in all products requiring Standard Response functional properties as defined by local agencies or authorities in the USA, Europe and Asia and as specified in International Standard ISO 6182:1.

These types of thermo bulbs are used applications where Insurers Hazard Classifications require sprinklers, which have an RTI<80, e.g., as per LPC's attachment to BS 5306:2, TB 20: Selection of Sprinkler Heads, in the UK and for Concealed or Recessed type sprinklers. Other international regulations also require Intermediate Response bulbs.

These bulbs are specified for domestic sprinklers in the USA and where Insurers Hazard Classifications require Fast Response—or in Extended Coverage Sprinklers, which require faster operational times due to the increased distance between installed sprinklers.

The Super Fast and Ultra Fast bulbs F2.5, F2 and F1.5 are typically used in high performance products where very early activation is essential. Examples are ESFR Sprinklers or Water Mist products.

Previously known glass bulbs, which satisfy the appropriate standards imposed by insurance or governmental agencies, generally have a diameter between 8 and 12 mm, a wall thickness of 1 to 1.5 mm, and an overall length of 20 to 30 mm. Such relatively thick glass bulbs do not respond quickly to heat from a fire, and have rather long release times, i.e., the time lapse from the first occurrence of critical temperature to be sensed to the shattering of the bulb and release of the valve. Such long release times are a result of the unfavorable ratio of the heat-absorbing surface of the bulb to the volume within the bulb to be heated. U.S. Pat. No. 4,796,710 (JOB® GmbH) discloses a bulb with a unique bone shape design that uses reinforced ends to absorb loads from the mounting supports and to introduce these axially into a shaft of reduced diameter thus avoiding unfavorable shearing and bending stresses in the glass. The bone shape design allows for a low mass structure, which, combined with the special filling liquid, provides very short response time. But it is expensive to manufacture with the cost of the bulb approximately 40-50% of the total cost of a sprinkler head. It is also fragile and requires careful packaging to avoid damage during shipping and installation.

SUMMARY OF THE INVENTION

The subject innovation involves using a very robust, fast response, shape memory alloy (SMA) element as the sprinkler activation mechanism. Similar to the glass bulbs, the tube or bulb is compressed onto a plug that traps and secures the fire fighting fluid. The brittle tube can be cheaply cast or extruded using, for example, tempered glass, brittle ceramics or brittle metals so that when it fractures it does not obstruct the release of the sprinkler plug. By memorizing the SMA element into novel shapes, the invention leads to a fast response and robust sprinkler activation system. Once the sprinkler's environmental temperature exceeds the transition temperature of the SMA material, the SMA material strains to recover its memorized shape, fracturing the brittle tube, releasing the plug and thus the fire fighting fluid.

The subject invention, however, in other embodiments, need not achieve all these objectives and the claims hereof should not be limited to structures or methods capable of achieving these objectives.

The subject invention features, in one embodiment, a sprinkler head comprising a sprinkler body with a passage for fluid, a seal mechanism sealing said passage, a cage member, a frangible bulb extending between the cage member and the seal, and a shape memory alloy element associated with the frangible bulb having a first configuration that fits with the bulb and a second configuration at a predetermined temperature which breaks the frangible bulb releasing the fluid through the passage.

In one example, the shape memory alloy element is within the bulb. In one version, the shape memory alloy element in the second configuration expands to break the bulb. Typically, the bulb has an inner diameter and the shape memory alloy element in the first configuration has an outer diameter less than the inner diameter of the bulb and in the second configuration the shape memory alloy element has an outer diameter larger than the inner diameter of the bulb. In another version, the shape memory allow element in the second configuration bends to break the bulb.

Further included may be a compound sealing the shape memory alloy element within the bulb. The preferred compound is thermally conductive and has a coefficient of thermal the same as or approximately the same as the coefficient of thermal expansion of the bulb.

In another example, the shape memory alloy element is about the bulb. In one version, the shape memory alloy element in the second configuration constricts to break the bulb. In another version, the shape memory alloy element induces a bending moment to break the bulb. Also, the shape memory alloy element may be asymmetric. In still another version, the shape memory alloy element has two holes and a bent portion in the first configuration and the holes constrict and the bent portion straightened in the second configuration to break the bulb.

The shape memory alloy element may be configured to expand to break the bulb. In one example, the shape memory alloy element is inside the bulb. In another example, the shape memory alloy element resides between the cage and the bulb.

The shape memory alloy element may have at least one orifice receiving the bulb. In one example, the shape memory alloy element includes preformed cracks extending from the orifice creating tensile stresses in the bulb in the second configuration.

Typically, the shape memory alloy element is deformed below the predetermined temperature into said first configuration when the shape memory alloy element is in its martinsite phase and the shape memory alloy element in its second configuration returns to its undeformed austenitic phase state above said predetermined temperature. The predetermined temperature is typically the transition temperature of the shape memory alloy material between its austenitic and martinsite phases.

The bulb can be made of glass or ceramic material and the bulb can be hollow or solid depending on the application.

The subject invention also features a sprinkler head comprising a sprinkler body with a passage for fluid, a frangible bulb functioning to seal the passage and a shape memory alloy element associated with the frangible bulb having a first configuration which fits with the bulb and a second configuration at a predetermined temperature which breaks the frangible bulb releasing the fluid from the sprinkler body. The shape memory alloy element may be within, about, or abutting the bulb.

The subject invention also features a temperature sensitive device comprising a frangible bulb and a shape memory alloy element associated with the frangible bulb having a first configuration which fits with the bulb and a second configuration at a predetermined temperature which breaks the frangible bulb. Again, the shape memory alloy element may be about, within, or abutting the bulb.

The subject invention also features a method of manufacturing a temperature sensitive device. The preferred method includes acquiring shape memory alloy material having an undeformed austenitic phase above a transition temperature. When the shape memory alloy material is in its martinsite phase below the transition temperature, it is deformed to fit with a frangible bulb.

The shape memory alloy material may reside within the bulb in the deformed shape. In the second configuration, the shape memory alloy material expands to break the bulb. In one example, the bulb has an inner diameter and the shape memory alloy element in its deformed shape has an outer diameter less than the inner diameter of the bulb and in its undeformed shape the memory alloy element has an outer diameter larger than the inner diameter of the bulb. The shape memory alloy element may also bend into its undeformed shape to break the bulb.

In one example, the shape memory alloy element is about the bulb. The shape memory alloy element may constrict when returning to its undeformed shape to break the bulb. The shape memory alloy element may also induce a bending moment when returning to its undeformed shape to break the bulb. If the shape memory alloy element has two holes and a bent portion in the deformed shape, the holes constrict and the bent portion straightens when returning to the undeformed shape to break the bulb.

The subject invention also features a sprinkler head comprising a sprinkler body with passage for fluid, a seal mechanism for said passage, a cage member, and a shape memory alloy element extending between the cage and the seal mechanism biasing the seal closed in a first configuration. The shape memory alloy element has a second configuration at a predetermined temperature releasing the seal mechanism and allowing fluid to flow through the passage. Typically, the shape memory alloy element has a length sufficient to bias the seal mechanism closed in the first configuration and the length shrinks in the second configuration upon reaching the predetermined temperature.

In yet another example, there is no frangible bulb. A sprinkler head includes a sprinkler body with passage for fluid and the shape memory alloy element serves to seal the passage mechanism in a first configuration. The shape memory alloy element has a second configuration at a predetermined temperature allowing fluid to flow through the passage. Typically, the shape memory alloy element has a length sufficient to seal the passage in the first configuration and the length shrinks in the second configuration upon reaching the predetermined temperature.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
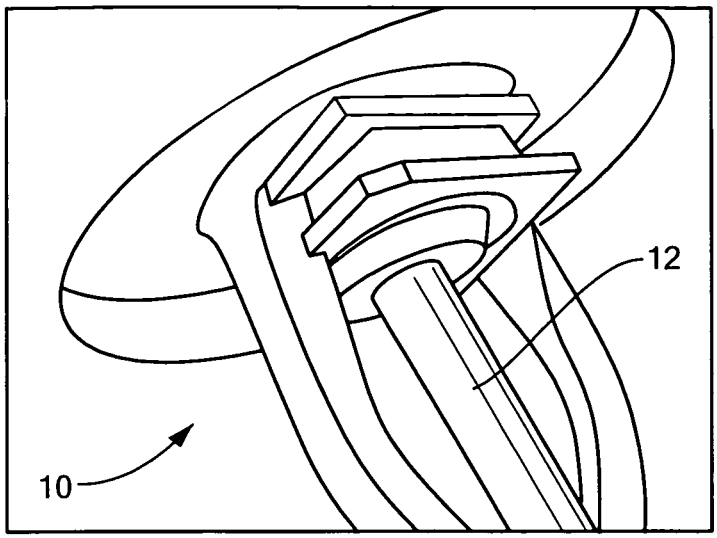
FIG. 1 (PRIOR ART)
FIG. 1 is a schematic three-dimensional view of a prior art sprinkler head.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
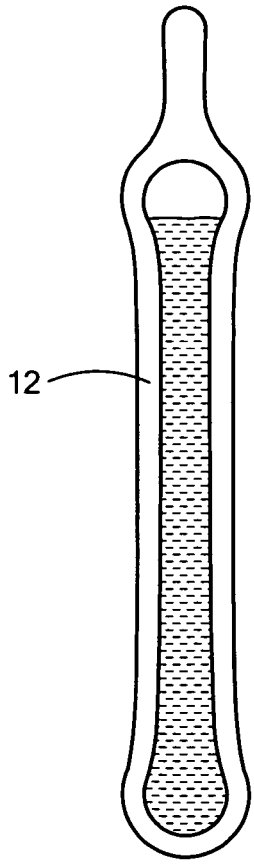
FIG. 2 (PRIOR ART)
FIG. 2 is a schematic front view showing the frangible bulb employed with the prior art sprinkler head of FIG. 1.
Figure 3:
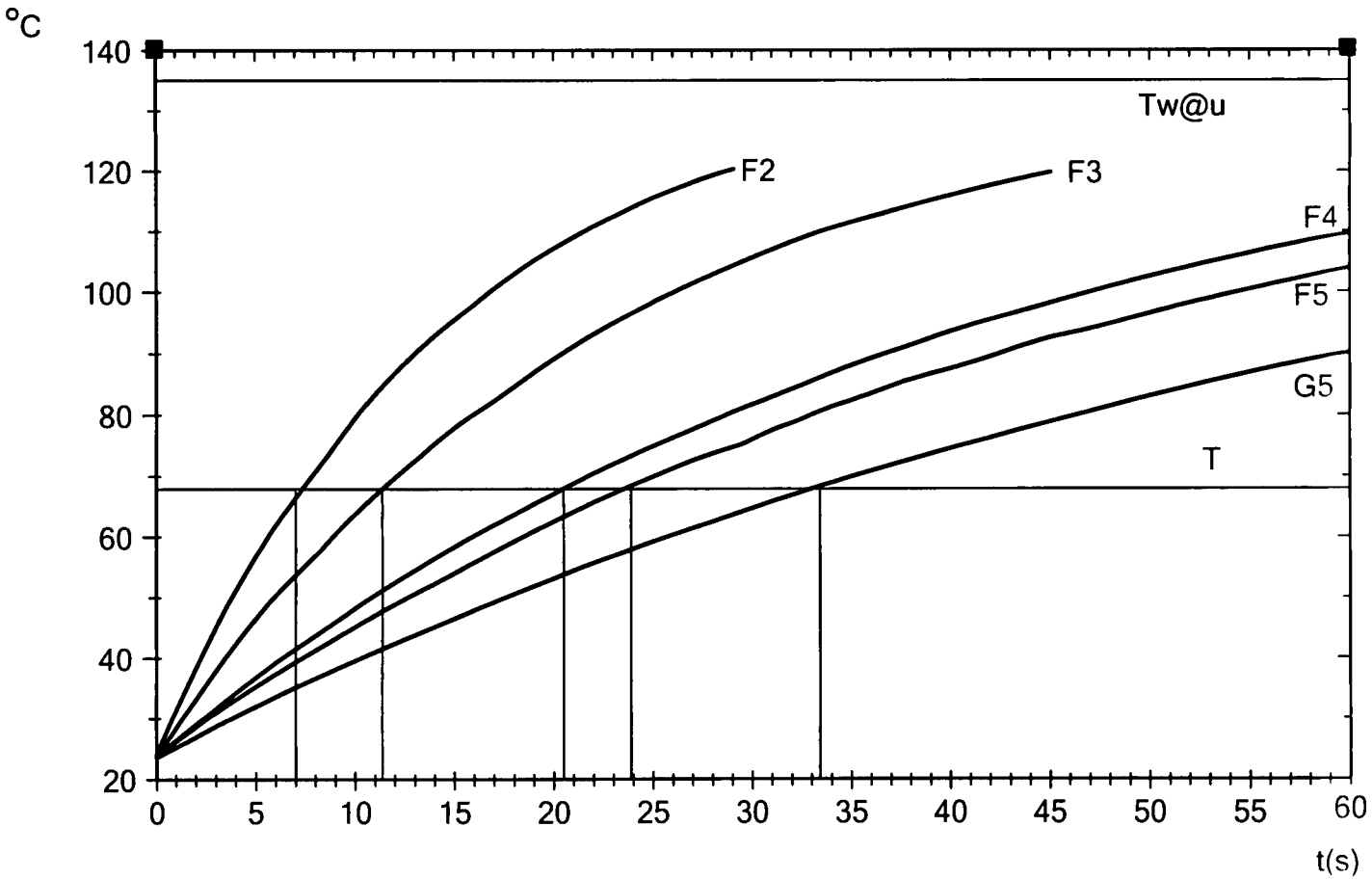
FIG. 3 is graph showing the different times required to activate different frangible sprinkler head bulbs.

FIG. 1 shows prior art sprinkler head 10 with a hollow frangible bulb 12 also shown in FIG. 2. Bulb 12 may vary widely in design but generally is made with glass and filled with a fluid that expands to break the glass at high temperatures. FIG. 3 shows the activation time for several JOB® bulbs.

In accordance with the subject invention, a shape memory alloy element is used as the means to break the frangible bulb typically used in a sprinkler. The shape memory alloy element may be associated with the bulb in a number of different ways: the shape memory alloy element may be inside the bulb around it, or abutting the bulb. The shape memory alloy element may expand, contract, bend, straighten, or induce a bending moment to break the bulb. In still another embodiment, no "bulb" is needed and the shape memory alloy element itself serves as the means to activate the sprinkler.

In one example, Nitinol is used as the shape memory alloy element. Nitinol is a shape memory alloy of Nickel and Titanium. It undergoes a phase transition from a martensitic to an austenitic structure with temperature. With careful "training" of a Nitinol wire, it can be made to change its length by eight percent when raised above the transition temperature. Since the Nitinol wire is resistive, application of a current through the wire can cause heating that induces the phase transition and contracts the wire. When the current is removed, the wire is cooled by the surroundings and can be returned to its original length. When used in a loaded situation, the following holds:

$$\epsilon=\sigma E+\Lambda \tag{2}$$

where $\epsilon$ is the total stain, $\sigma$ the stress, E the modulus of elasticity of the material and $\Lambda$ the induced strain due to actuation. That is, total strain is the sum of mechanical strain and actuation strain.

In general, materials that exhibit an extremely variable crystal structure with respect to temperature are known as Shape Memory Alloys (SMAs). Discovered in 1932 by Swedish researcher Arne Olander, SMAs return to their undeformed state when heated. When the alloy is below its transition temperature, it is in its martensite phase. In the Martensitic Phase the alloy can be strained by 3%-8% with very low applied stresses. If the temperature of the alloy is raised above the transition temperature, the material changes to its austenitic phase and recovers to its original, undeformed shape. In the austenitic phase, the material is capable of withstanding large physical loads and can be used as an actuator.

SMA also exhibits pseudoelasticity (also known as superelasticity). The seemingly plastic behavior is through stress induced martensite. The material elastically returns to zero strain (Austenite) without heat input. However when the stress is removed, the material does not follow the same path on the Stress-Strain curve as when it was loaded. Energy is thus dissipated, concluding that the material is an excellent energy-absorbing material in the pseudoelastic form.

SMAs can be used as strain sensors since they also exhibit measurable changes in resistance when they are strained. For example, the resistance of an un-stretched 55 cm long, 1 mm diameter Nitinol wire is 0.85Ω. When the wire is stretched by 6.5% the resistance is 0.87Ω. Note that the Nitinol in the pseudoelastic form can strain to 5% without permanent deformation. See Table 1 below:

TABLE 1

| Properties of Nitinol | | | | |
|---|---|---|---|---|
| Property | | 50 μm | 150 μm | 250 μm |
| Physical | Minimum Bend Radius [mm] | 2.5 | 7.5 | 12.50 |
| | Cross-Sectional Area [$\mu m^2$] | 1,960 | 17,700 | 49,100 |
| Electrical | Recommended Current [mA] | 50 | 400 | 1,000 |
| | Recommended Power [W/m] | 1.28 | 8.00 | 20.0 |
| Strength | Max. Recovery Force @600 Mpa [N] | 1.15 | 10.35 | 28.74 |
| | Rec. Recovery Force @ 190 Mpa [N] | 0.34 | 3.32 | 9.11 |
| Speed | Max. Contraction Speed [sec] | 0.1 | 0.1 | 0.1 |
| | Relaxation Speed [sec] | 0.3 | 2 | 5.5 |
| | Typical Cycle Rate [cyc/min] | 46 | 20 | 9 |
| Thermal & Material | Heat Capacity [cal/g° C.] | | 0.077 | |
| | Density[g/cc] | | 6.45 | |
| | Maximum Deformation Ratio [%] | | 8 | |
| | Recommended Deformation [%] | | 3-5 | |
| | Resistivity [μΩcm] | Low Temp | | High Temp |
| | Young's Modulus [GPa] | 76 | | 82 |
| | Thermal Conductivity [W/cm° C.] | 28 | | 75 |
| | | 0.08 | | 0.18 |

Figure 4B:
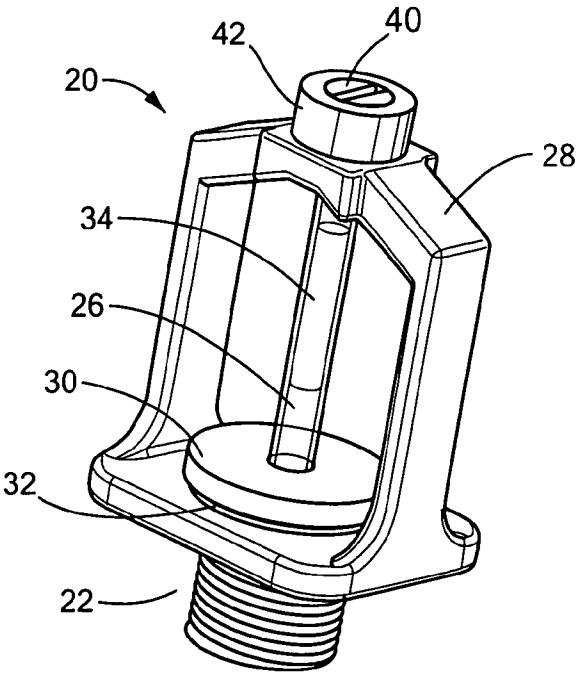
FIG. 4B is a schematic three-dimensional view of a new assembled sprinkler head in accordance with the subject invention.
Figure 4A:
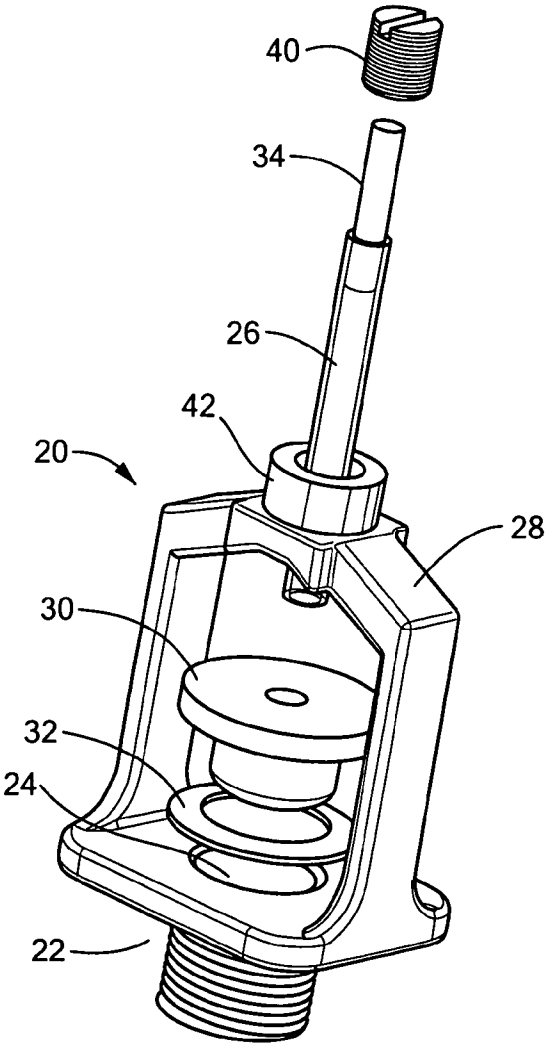
FIG. 4A is a schematic three-dimensional front exploded view of an example of a new sprinkler head in accordance with the subject invention.

In one example of the subject invention, a simple, low cost, approach is used to form a fast response sprinkler head system. FIG. 4A shows sprinkler head 20 with body 22 defining passage 24 through which fluid flows when bulb 26 breaks. Head 20 is typically made of cast bronze or equivalent. It is preferred that the material used has a coefficient of thermal expansion near the thermal coefficient expansion of the other components of the sprinkler head. In one example, bulb 26 is a hollow ceramic tube. The bulb, however, could be solid, of many different shapes and sizes, and made of different materials. The bulb could also include rounded ends to reduce stress and increase strength. Sprinkler head 20 includes cage 28 and sealing mechanism such as saddle 30 configured to both seal passage 24 and receive one end of bulb 26 as shown in FIG. 4B. Belville washer 32 may also be included.

In this particular example, shape memory allow element 34 is a cylindrical rod with an outer diameter in one configuration which is smaller than the inner diameter of bulbs 26. In this configuration, shape memory alloy element 34 is placed within bulb 26. Set screw 40 is used to seal the open end of bulb 26, and when inserted in cage 28 housing 42, the set screw positions bulb 26 between cage 28 and seal 30 compressing washer 32. When a predetermined temperature is reached, shape memory alloy element 34 has a second configuration: the diameter of shape memory allow element 34 increases fracturing bulb 26. Pressurized fluid (e.g., water) in passage 24 pushes seal 30 out of the way and the fluid is thus released.

As received from the material supplier, the diameter of the SMA element 34 is slightly larger than the inner diameter of brittle bulb 26. Element 34 is stretched cold to decrease the diameter to be slightly smaller than the inner diameter of bulb 26. The stretched element 34 is placed into brittle bulb 26. A small amount of glue can be used to ensure that element 34 remains roughly in the middle portion (length direction) of bulb 26. The brittle bulb can be glass, tempered glass, ceramic and or any other material that will exhibit brittle fracture. In order to keep the response time of the sprinkler fast, the bulb wall thickness is preferably thin to allow the bulb with the inserted element 34 to equilibrate quickly to changes in the temperature of the environment.

When the temperature of environment at or slightly above the martensite to austenite transition temperature of the material of element 34, the stretched element will strain to return to its memorized shape, which is by design shorter and thicker. Once the diameter of element 34 reaches the inner diameter of bulb 26, the element will induced hoop stresses in the brittle bulb causing the bulb to fail and since the failure is brittle it will shatter and remove the bulb from the load path allowing seal 32 to be pushed out by the pressurized fire fighting fluid.

The phase transition temperature of the SMA material can be altered by changing the composition of the material, allowing the activation temperature to be tailored to a desired temperature. Composition changes can yield phase transition temperatures between 30° C. (86° F.) and 95° C. (203° F.).

Figure 5A:
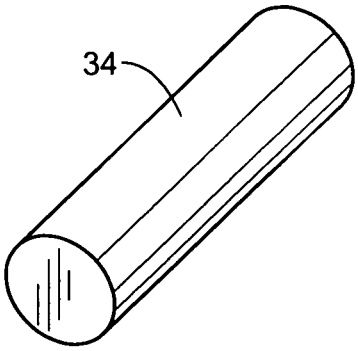
FIG. 5A is a schematic three-dimensional top view of a shaped memory alloy element in accordance with the subject invention in its undeformed configuration.
Figure 5B:
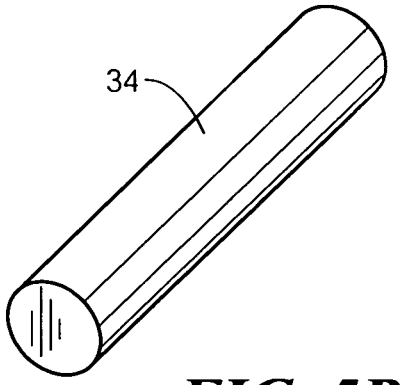
FIG. 5B is a schematic three-dimensional top view showing the shape memory alloy of FIG. 5A in its deformed state.

FIG. 5A shows SMA element 34 before being stretched. When temperature of the sprinkler's environment exceeds the phase transition temperature of the SMA material, the element will return to this shape. FIG. 5B shows the cold SMA element after being stretched. Note that it is longer and thinner.

Figure 6A:
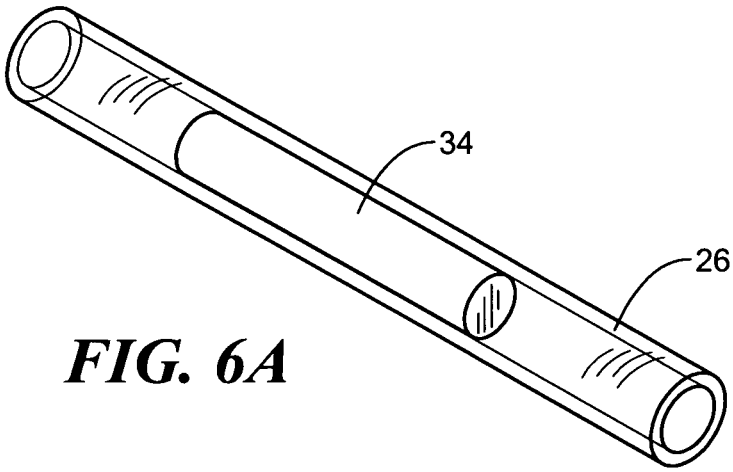
FIG. 6A is a schematic three-dimensional top view showing the shape memory alloy element of FIG. 5B placed inside a frangible tube in accordance with the subject invention.
Figure 6B:
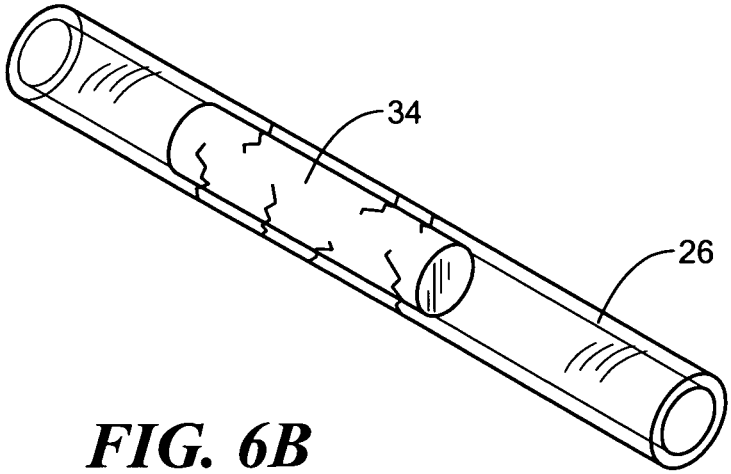
FIG. 6B is a schematic three-dimension top view showing the shape memory alloy element of FIG. 5B fracturing the frangible tube.

FIG. 6A shows SMA element 34 with a diameter slightly larger than the inner diameter of brittle bulb 26 stretched cold to a diameter smaller than the inner diameter of the bulb 26 and inserted in brittle bulb 26. In FIG. 6B, when the environmental temperature reaches the transition temperature of the SMA material, SMA element 34 expands and strains against the inner walls of brittle tube causing the bulb 26 to fracture. Before SMA element 34 is inserted in the ceramic bulb, it is stretched so that the material is deformed in its Martensitic state. Stretching of the material increases its length but also decreases, through the Poisson's effect, the diameter of element 34. Starting with a 2.44 mm diameter element, the stretching of the element reduces the diameter to 2.39 mm or less. Bulb 26 has a 3.9 mm outer diameter and a 2.4 mm inner diameter. Embedded or placed inside this bulb is a 2.44 mm SMA cylinder that was stretched to have a diameter of 2.39 mm. Also, a 2.44 mm SMA cylinder was stretched to a diameter of 2.39 mm running through a 3.9 mm outer diameter bulb and partially into a bulb with an outer diameter of 4.8 mm. The inner diameters of both bulbs were 2.4 mm. After the thermal environment was increased to exceed the transition temperature of the SMA material, approximately 80° C., the expanding SMA had the ability to fracture all the ceramic bulbs.

Figure 7A:
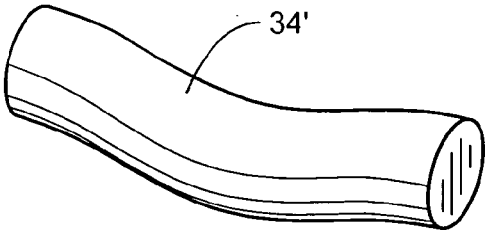
FIG. 7A is a schematic three-dimensional top view showing another example of a shape memory alloy element in its undeformed state.
Figure 7B:
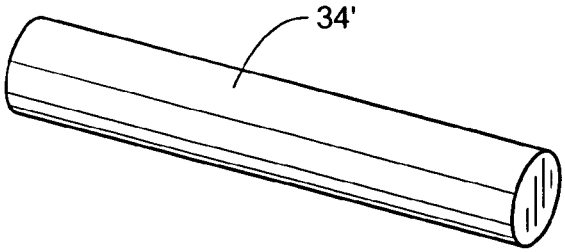
FIG. 7B is a schematic three-dimensional top view showing the shape memory alloy element of FIG. 7A in its deformed configuration.

Another embodiment also features a simple, low cost, approach used to form a fast response sprinkler head system. As received from the material supplier, the diameter of SMA element 34', FIGS. 7A-7B, is slightly smaller than the inner diameter of the brittle bulb. The element is memorized into a curved shape as shown in FIG. 7A before it is rolled or stretched as shown in FIG. 7B to fit inside the brittle bulb. A small amount of glue can be used to ensure that the element remains roughly in the middle portion (length direction) of the bulb. As before, the brittle bulb can be glass, tempered glass, ceramic and or any other material that will exhibit brittle fracture. In order to keep the response time of the sprinkler fast, the bulb wall thickness is preferably thin to allow the bulb with the inserted SMA element to equilibrate quickly to changes in the temperature of the environment.

When the temperature of environment at or slightly above the martensite to austenite transition temperature of the SMA material, the stretched SMA element will strain to return to its memorized bent shape shown in FIG. 7A. In this example, a double curvature is used but other shapes can achieve the same result. When the SMA element strains to the point where it comes into contact with the inner diameter of the bulb, the SMA element will stress the bulb causing the bulb to fail. Since the bulb failure is brittle it will shatter and remove the bulb from the load path allowing the sealing member to be pushed out by the pressurized fire fighting fluid. The memorized shape is designed to be such that it induces a bending moment on the bulb helping the bulb to be fracture in such a manner that it fails in such a way that it clears a path for the seal to be reliably released.

FIG. 7A shows the SMA element with a memorized double inflection shape. Memorization was performed in a jig and with appropriate heat treatment of the material. FIG. 7B shows the SMA element after it was straightened. Note that it is thinner and straight. When the temperature of the sprinkler's environment exceeds the phase transition temperature of the SMA, the element will return to its pre-stretched shape.

Figure 8A:
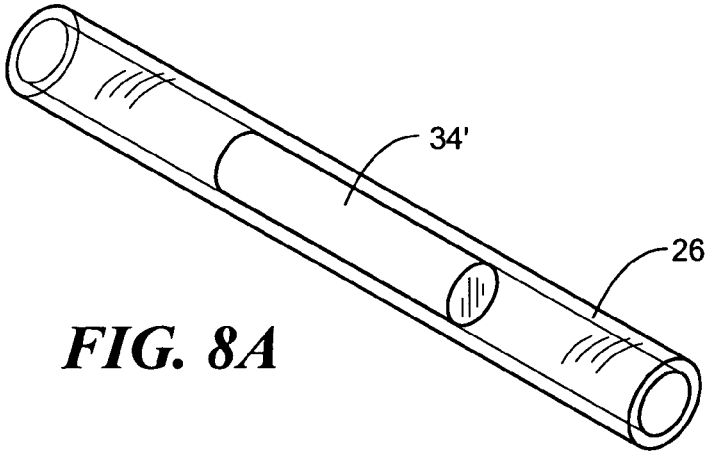
FIG. 8A is a schematic three-dimensional top view showing the shape memory alloy element of FIG. 7B within a glass tube in accordance with the subject invention.
Figure 8B:
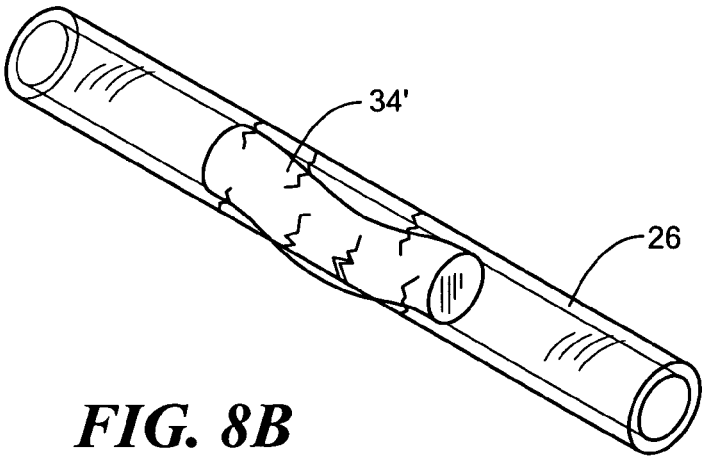
FIG. 8B is a schematic three-dimensional top view showing the shape memory alloy element of FIG. 7A breaking the frangible tube.
Figure 10:
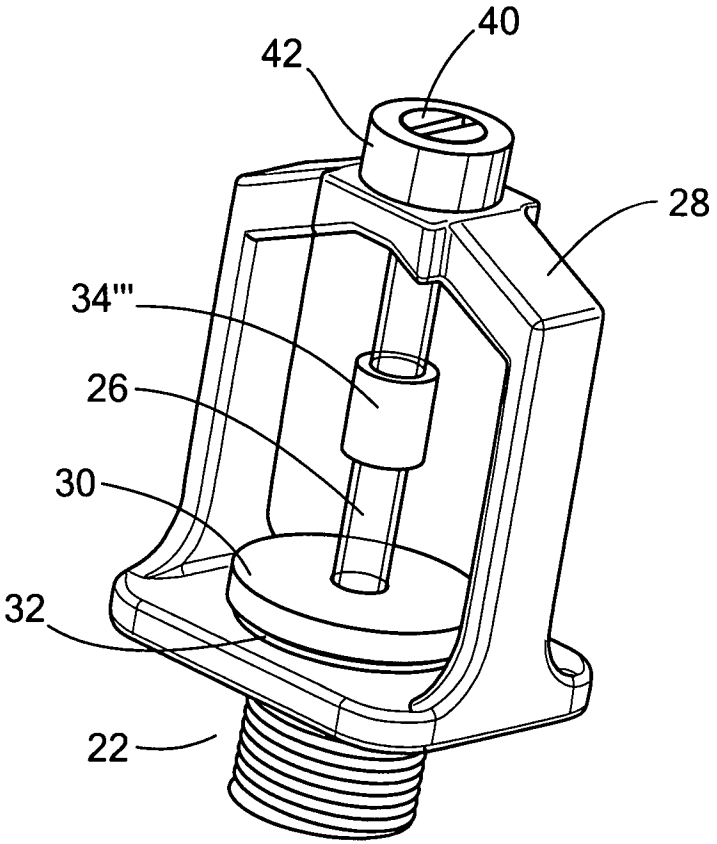
FIGS. 9, 10, 11A, 11B, 12 and 13 are schematic three-dimensional views showing additional embodiments of the subject invention.

FIG. 8 shows SMA element 34' with a diameter slightly smaller than the inner diameter of brittle bulb 26. The memorized shape is a curved shape. After the memorization step, the element is cold rolled or cold stretched to be straight so that it can be inserted inside the brittle bulb 26. FIG. 8B shows when the environmental temperature reaches the transition temperature of the SMA material, SMA element 34' will attempt to return to its original curved shaped, straining against the inner walls of brittle bulb 26 causing the bulb to fracture.

Tests on small diameter ceramic bulbs ranging from 3.9 mm to 4.8 mm in outer diameter with a 2.4 mm inner diameter, in which a 2.4 mm round shape memory alloy cylinders was placed, concluded that the concept is feasible.

An SMA activated sprinkler system in accordance with the subject invention exhibits a time response to a change in temperature that equals or surpasses the response rate of glass bulbs. Table 2 below provides the thermal diffusivities of the elements in a glass bulb or an SMA rod inside a glass tube. Thermal diffusivity is a measure of how quickly materials heat in response to a change in the surrounding temperature. A material with a higher thermal diffusivity will respond faster to a change in temperature than a material with a lower thermal diffusivity.

TABLE 2

| | Thermal Diffusivity ($m^2/s$) | Normalized to the Diffusivity of Glass |
|---|---|---|
| Glass | $3.38 \times 10^{-7}$ | 1.0 |
| Liquid | $1.39 \times 10^{-7}$ | 0.41 |
| Nitinol | $2 \times 10^{-5}$ | 59.1 |

Air between the SMA rod and the brittle tube may delay heat getting into the SMA element slowing down the response time of the activation element. This can be avoided by using a thermally conductive adhesive or potting compound to secure the SMA rod inside the tube. Care should be taken to ensure the coefficient of thermal expansion (CTE) of the potting compound matches that of the brittle tube to avoid the tube being fractured by the compound during thermal excursions. An example of a thermally conductive adhesive is Pyro-Duct™ 598-A & 598-C from Aremco. This adhesive has a CTE near that of glass and can be used in applications seeing temperatures up to 1000° F. An example potting compound material is Ceramacast™ 675. Ceramacast™ 675 is a new high temperature, thermally conductive, aluminum nitride filled ceramic potting compound developed by Aremco Products, Inc. One compound, 675N, is now used in the production of quick response sensors such as thermocouples and resistance temperature detectors as well as high power resistors. Once cured, the material is brittle leading to a configuration where the potting compound can be the "bulb." Another candidate is the 512N single-part adhesive, coating and potting compound that is typically used in small electrical parts assembly. Both have CTEs close to that of glass.

In other examples, the SMA element is about the bulb rather than within it. In one embodiment, a hollow or solid ceramic bulb is inserted into a hollow shape memory alloy element to form the activating element. The hollow shape memory alloy element has a circular hole and the external shape can be arbitrary as shown in FIGS. 9-13. The hollow SMA element can also be formed by wrapping SMA wire around the ceramic tube and securing the ends of the wire with a crimping tool. The ceramic bulb can be hollow which will reduce the force required by the SMA activating element or solid which will increase the strength and robustness of the sprinkler assembly.

As received from the material supplier, the inner diameter of the SMA hollow element is preferably slightly smaller than the outer diameter of the brittle ceramic tube. The element is stretched cold to increase the inner diameter of the element to be slightly larger than the outer diameter of the bulb. The stretched SMA element is then slid over the brittle bulb. A small amount of glue can be used to ensure that the element remains roughly in the middle portion (length direction) of the bulb. The brittle bulb can be glass, tempered glass, ceramic and/or any other material that will exhibit brittle fracture. It's shape may vary. In order to keep the response time of the sprinkler fast, the SMA element preferably has as little as possible material to allow the SMA element to equilibrate quickly to changes in the temperature of the environment.

When the temperature of the environment is at or is slightly above the martensite to austenite transition temperature of the SMA material, the stretched hollow SMA element will strain and constrict to return to its memorized shape: its inner diameter will be smaller than the outer diameter of the bulb. Once the SMA's inner diameter reaches the outer diameter of the bulb, the SMA element will induce compressive hoop stresses in the brittle bulb causing the bulb to fail.

One attractive feature of this embodiment is that the SMA material, which has excellent heat conductivity and thermal diffusivity (the rate at which a material changes its temperature when there is a change in temperature), is outside the bulb directly exposed to the environment. This ensures a fast response sprinkler system and also allows the use of Pyrex bulbs. Pyrex has excellent strength but poor heat conduction which would eliminate use of Pyrex for prior art fast response sprinkler systems.

Figure 9:
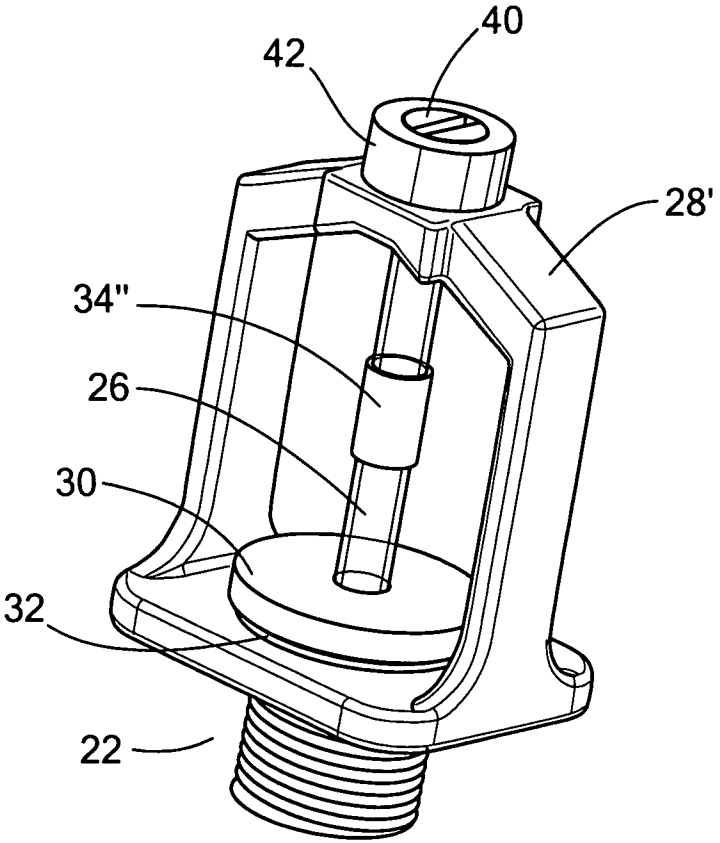
Figure 11A:
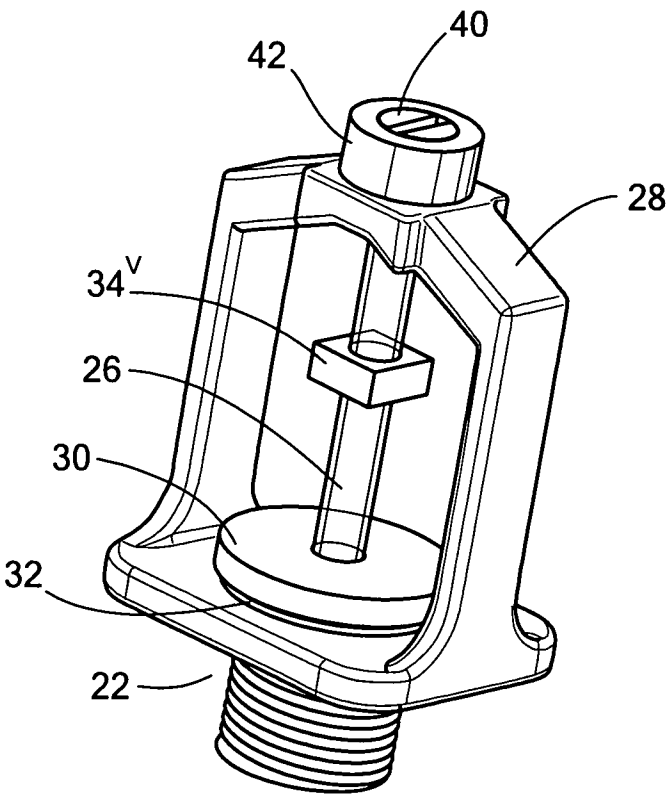
Figure 11B:
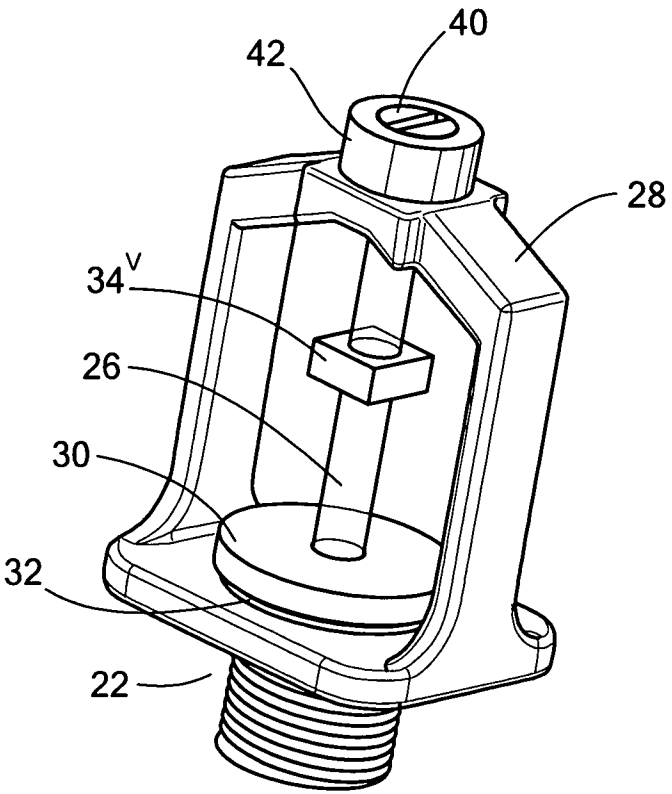

FIG. 9 shows sprinkler head 20' with shape memory alloy element 34" about bulb 26. Element 34" is a thin walled tube. Shape memory alloy element 34", FIG. 10, in contrast, is a thicker walled tube. In FIGS. 11A and 11B, shape memory alloy element $\mathbf{34}^{iv}$ is a rectangular washer-shaped piece.

Figure 12:
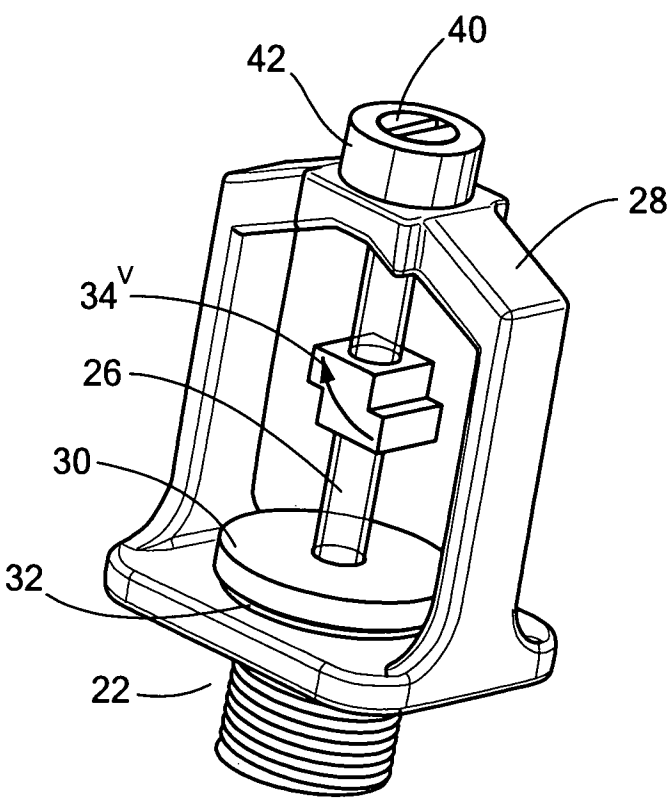

Features can be added to the hollow element to improve the ability of the element to crush a thicker ceramic tube or a solid ceramic tube. One such feature is shown in FIG. 12. In this figure the activating element $\mathbf{34}^{v}$ is non-symmetric in the axial direction. The result is an unequal crushing force which, in turn, will introduce a bending moment that will create tensile stresses in bulb 26. Since ceramics are weak in tension, this feature will enhance the ability of the SMA activating element to fracture a ceramic bulb and since the failure is brittle it will shatter and remove the bulb from the load path.

Figure 13:
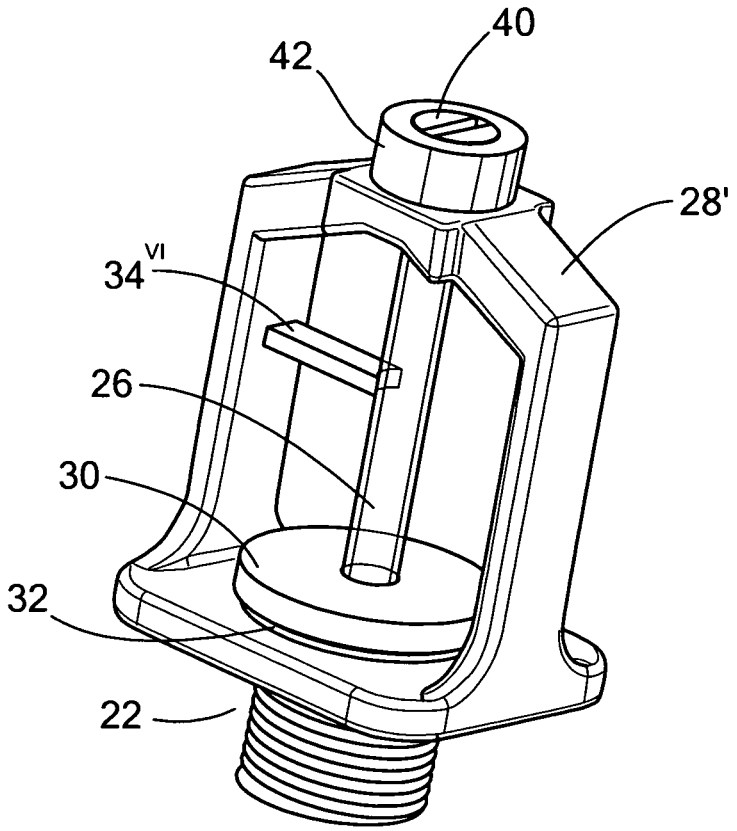

FIG. 13 shows SMA active element $\mathbf{34}^{vi}$ associated with bulb 26 and extending between cage 28 and bulb 26. Element $\mathbf{34}^{vi}$ is configured to extend in length and fracture bulb 26 when the temperature reaches or is slightly above the martensite to austenite transition temperature of the SMA material.

Figure 14A:
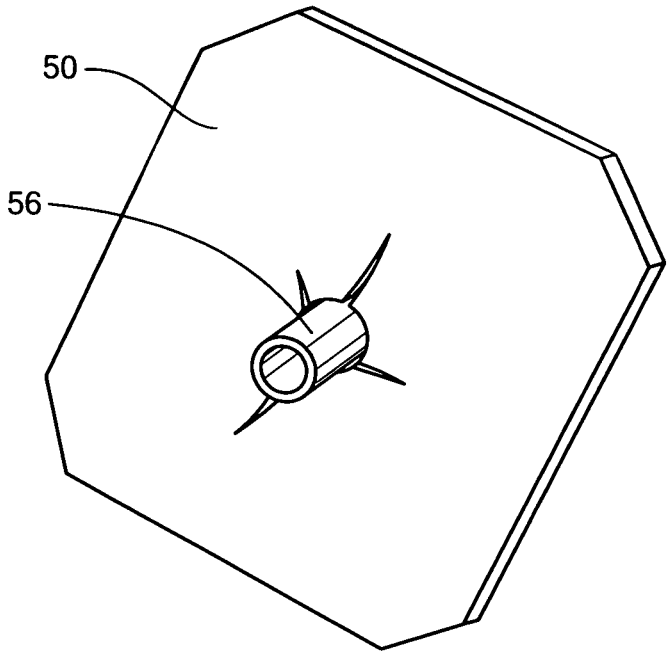
FIG. 14A is a schematic three-dimensional top view of an SMA plate having been punched and stretched to the outer diameter.
Figure 14B:
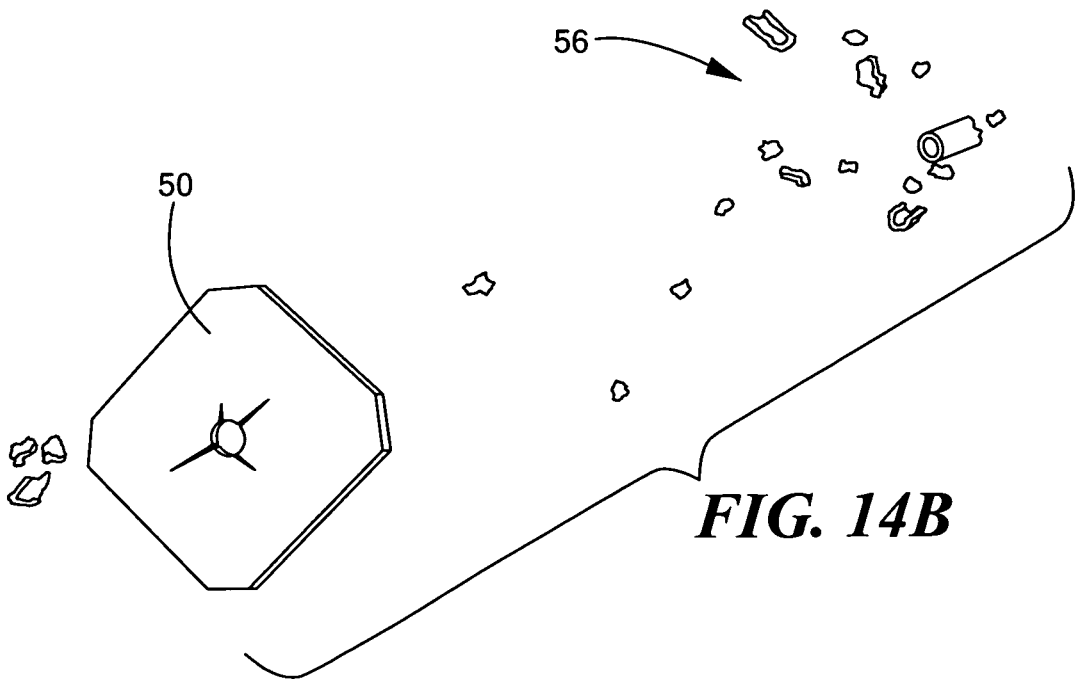
FIG. 14B is a schematic three-dimensional top view of a shattered glass tube after being heated above its transition temperature.

FIGS. 14A and 14B show a thin (e.g., between 0.02" and 0.04") SMA plate 50. A hole was punched in the plate and the hole was stretched using tapered punch 54, FIG. 16. A glass tube 56 was inserted into the hole as shown in FIG. 14A and the SMA was heated with a heat gun. Once the temperature of the SMA material was above the transition temperature, the SMA strained to recover it "flat" memorized shape and shattered the glass tube, FIG. 14B.

Figure 15:
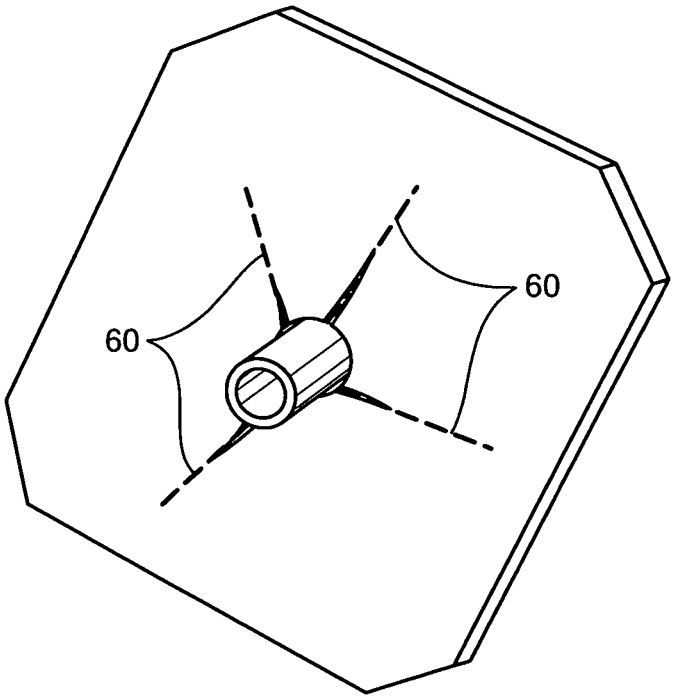
FIG. 15 is a schematic top view showing the cracks around the hole induced when a punch was used to stretch the hole.
Figure 16A:
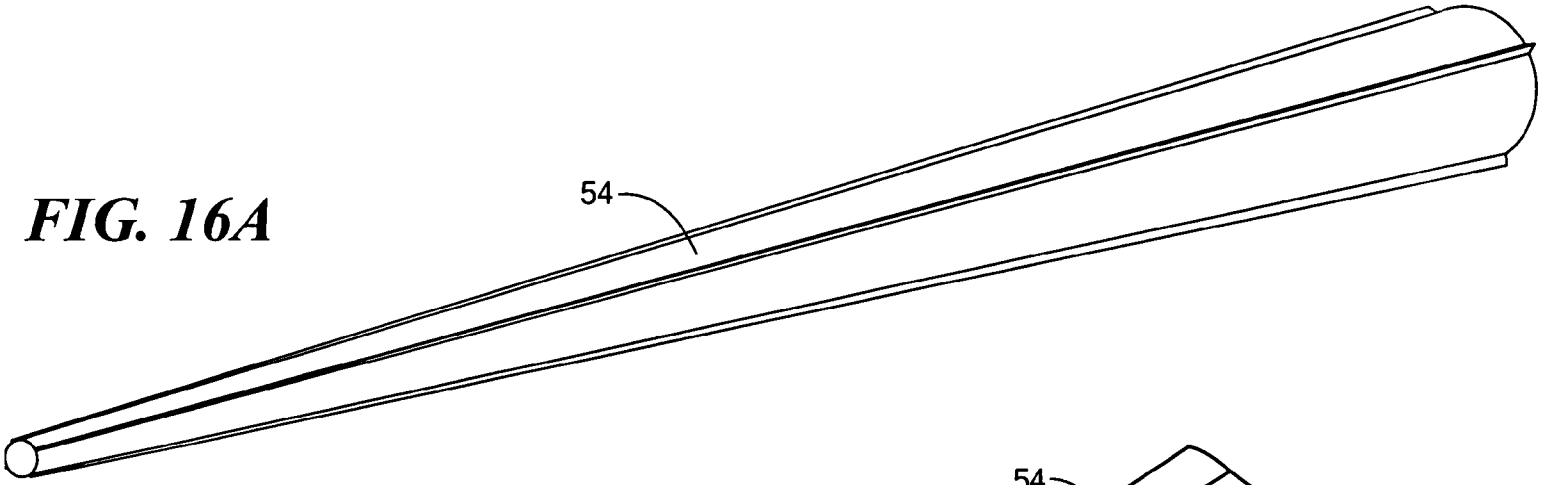
FIG. 16A is a schematic three-dimensional view of a punch with four sharp ridges to ensure that the SMA cracks around the hole in a predefined pattern.
Figure 16B:
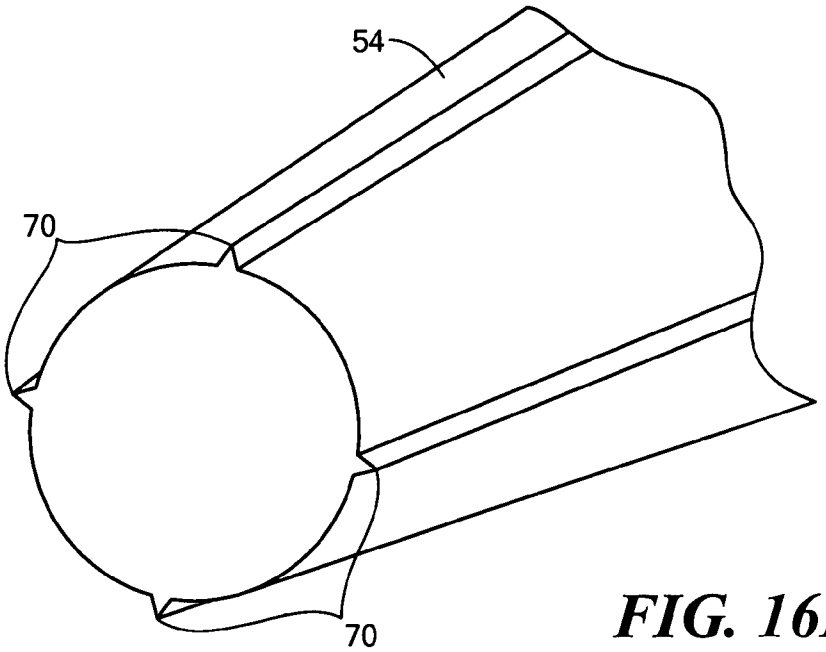
FIG. 16B is a schematic three-dimensional close-up view of the tip of the punch.

One feature of this embodiment is that when the hole in the SMA is stretched, cracks 60 form around the hole, FIG. 15. These cracks enhance the ability of the SMA material to fracture the glass tube since it introduces an uneven stress pattern around the circumference of the glass bulb. At and near the cracks, the stresses are lower than the areas between the cracks. This creates tensile stresses in the bulb and since brittle materials are typically weak in tension, the cracks allow the SMA material to shatter the glass tube and ensure that the glass tube is completely removed from the load path, releasing the fire quenching liquid. As shown in FIGS. 16A and 16B, punch 54 with a predefined number of sharp ridges 70 can be used to ensure that the SMA material cracks around the hole in a predefined pattern.

Figure 17A:
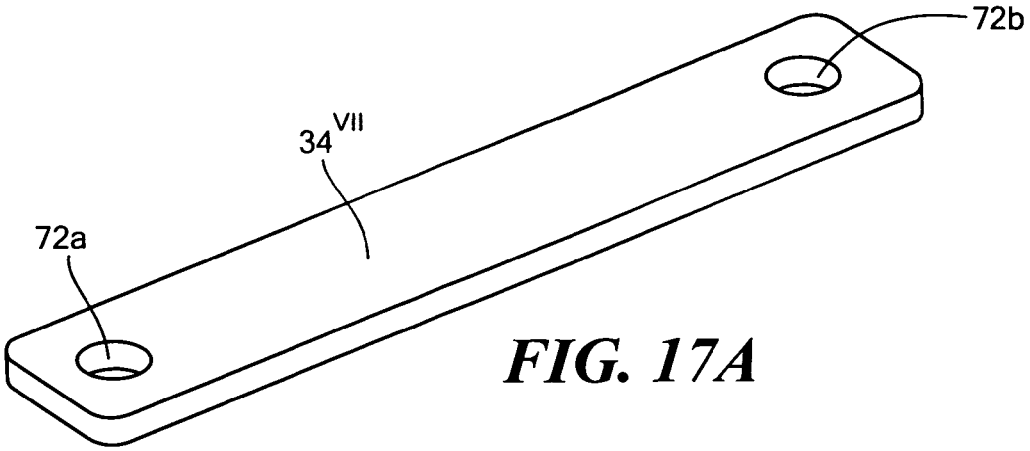
FIG. 17A is a schematic three-dimensional view of an SMA plate element with two holes in its flat memorized shape.
Figure 17B:
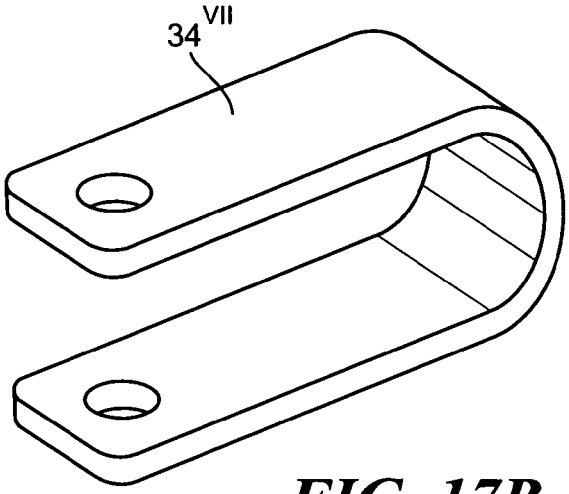
FIG. 17B is a schematic three-dimensional view of an SMA plate element with stretched holes and bent into a U-shape to allow the ceramic tube or rod to be inserted through both holes.
Figure 18:
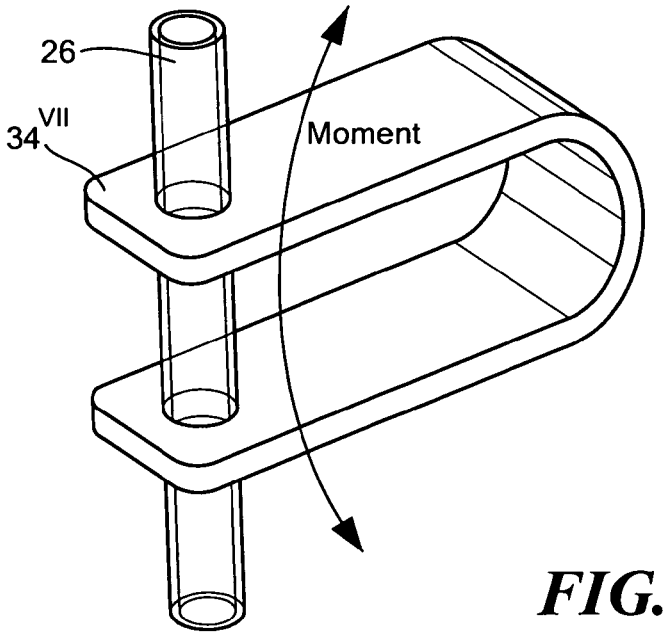
FIG. 18 is a schematic three-dimensional side view of an SMA plate element with a ceramic tube or rod inserted through the two holes.

Reliability can also be improved through a double hole SMA element $\mathbf{34}^{vii}$, FIG. 17A. Two holes 72*a* and 72*b* are punched in a SMA plate at a distance far enough apart to allow the element to be bent into a U-shape, FIG. 17B. The punched hole diameters are smaller than the outer of bulb 26. After the holes are stretched using tapered punch 54, FIGS. 16A-16B, the SMA plate is bent into the U-shape and the bulb is inserted through both holes as shown in FIG. 18. When the environmental temperature of the sprinkler reaches the phase transition temperature of the SMA material, the SMA element strains to recover its flat, small hole shape causing the shrinking holes to apply pressure to the bulb and also applying a bending moment. Redundancy is achieved through the two shrinking holes and the applied bending moment.

Figure 19:
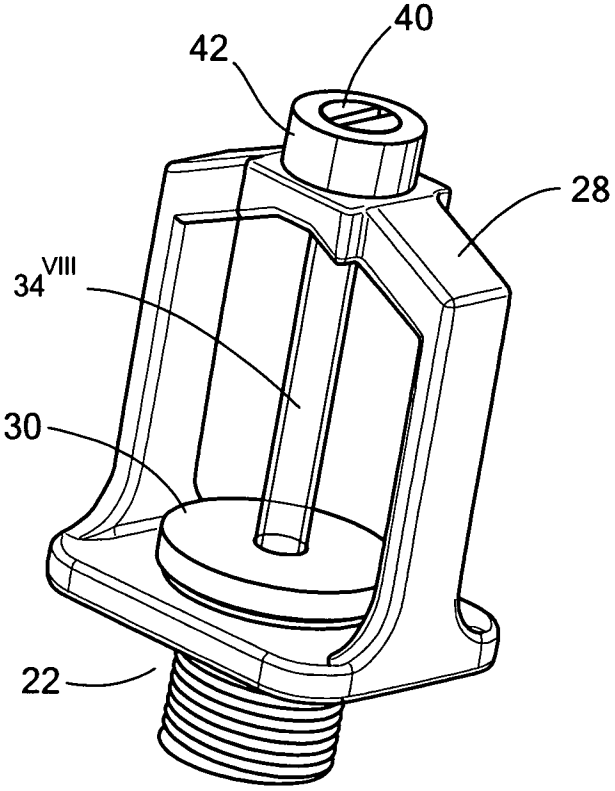
FIG. 19 is a schematic view of another embodiment of a sprinkler head in accordance with the subject invention.

FIG. 19 shows still another embodiment where shape memory alloy element 100 extends between sprinkler cage 28 and seal 30. At room temperature, element 100 has a length which biases seal 30 to seal passage 22. At higher temperatures, element 100 shrinks to its memorized state and element 100 no longer biases seal 30 closed. The distal end of element $\mathbf{34}^{viii}$ could also be configured to serve as a sealing element.

The result, in any embodiment, is a simple, low cost approach is used to form a fast response sprinkler head system. The subject invention, however, is applicable to other devices currently using "thermo bulbs" and other temperature sensitive devices.

Thus, although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

What is claimed is:

1. A sprinkler head comprising:

a sprinkler body with a passage for fluid to flow therethrough;

a seal mechanism for sealing said passage;

a cage member;

a hollow frangible tube extending between the cage member and the seal mechanism; and a shape memory alloy element about the hollow frangible tube a rectangular washer shape and a having a first configuration that fits with the tube and a second constricted configuration at a predetermined temperature which breaks the frangible tube, releasing the seal mechanism and thus the fluid through the passage.

2. The sprinkler head of claim 1 in which the shape memory alloy element has at least one orifice receiving the bulb.

3. The sprinkler head of claim 2 in which the shape memory alloy element includes preformed cracks extending from the article creating tensile stresses in the bulb in the second configuration.

4. The sprinkler head of claim 1 in which the shape memory alloy element is deformed below the predetermined temperature into said first configuration when the shape memory alloy element is in its martinsite phase.

5. The sprinkler head of claim 4 in which the shape memory alloy element in its second configuration returns to its undeformed austenitic phase state above said predetermined temperature.

6. The sprinkler head of claim 5 in which said predetermined temperature is the transition temperature of the shape memory alloy element between its austenitic and martinsite phases.

7. The sprinkler head of claim 1 in which said bulb is made of glass or ceramic material.

8. The sprinkler head of claim 1 in which the hollow frangible tube is a bulb.

9. The sprinkler head of claim 1 in which the hollow frangible tube is made of brittle material.

10. The sprinkler head of claim 1 in which the hollow frangible tube is a thin walled hollow frangible tube.

* * * * *

UNITED STATES PATENT AND TRADEMARK OFFICE

CERTIFICATE OF CORRECTION

PATENT NO. : 9,180,326 B2
APPLICATION NO. : 12/381485
DATED : November 10, 2015
INVENTOR(S) : Van Schoor et al.

It is certified that error appears in the above-identified patent and that said Letters Patent is hereby corrected as shown below:

In the claims

Column 14, Line 34: "tube a rectangular washer shape and a having a first" should read --tube having a rectangular shape and a first--

Signed and Sealed this
Twenty-eighth Day of June, 2016

Michelle K. Lee

Michelle K. Lee
*Director of the United States Patent and Trademark Office*